US005537696A

United States Patent [19]

Chartier

[11] Patent Number: 5,537,696

[45] Date of Patent: Jul. 23, 1996

[54] APPARATUS FOR PRODUCING SHEET WATERFALL FOR POOL OR SPA

[75] Inventor: Clifford E. Chartier, 6061 Trajan Dr., Fair Oaks, Calif. 95628

[73] Assignees: Clifford E. Chartier, Fair Oaks; Sidney Gralicer, Rescue, both of Calif.

[21] Appl. No.: 400,214

[22] Filed: Mar. 7, 1995

Related U.S. Application Data

[62] Division of Ser. No. 972,404, Nov. 6, 1992, abandoned.

[51] Int. Cl.[6] ..... E04H 4/12

[52] U.S. Cl. ..... 4/507; 4/591; 4/569; 4/678

[58] Field of Search ..... 4/506, 507, 508, 4/509, 567, 569, 591, 597, 678

[56] References Cited

U.S. PATENT DOCUMENTS

| | | | |
|---|---|---|---|
| 1,198,303 | 9/1916 | Williams | 4/591 |
| 2,147,925 | 2/1939 | Schwalbe | 239/11 |
| 2,499,966 | 3/1950 | Neely | 4/569 |
| 3,022,016 | 2/1962 | Shrewsbury | 239/597 |
| 4,334,328 | 6/1982 | Delepine | 4/678 |
| 4,502,304 | 3/1985 | Hopkins | 239/590.3 |
| 4,877,084 | 10/1989 | Goggin | 239/523 |
| 4,881,280 | 11/1989 | Lesikar | 4/507 |
| 4,912,782 | 4/1990 | Robbins | 4/569 |
| 5,115,974 | 5/1992 | Tobias et al. | 239/23 |
| 5,127,111 | 7/1992 | Sieth | 4/591 |

FOREIGN PATENT DOCUMENTS

| | | | |
|---|---|---|---|
| 275084 | 7/1988 | European Pat. Off. | 4/576 |
| 2641802 | 3/1978 | Germany | 239/193 |

*Primary Examiner*—Henry J. Recla
*Assistant Examiner*—Charles R. Eloshway
*Attorney, Agent, or Firm*—Flehr, Hohbach, Test, Albritton & Herbert

[57] ABSTRACT

A self-contained module installed in the side walls or deck of a pool or spa is connected to the pool or spa plumbing system, and converts the turbulent water supply of the system to a laminar sheet of water which free falls into the pool or spa in a manner pleasing in sight and sound. Narrow, elongated spouts prevalent in the prior art have been reduced to a short, compact, economical and structurally stronger emitter owing to the provision of components including an apertured conduit, or "flute", traversing a relatively large manifold chamber open along an element.

27 Claims, 4 Drawing Sheets

APPARATUS FOR PRODUCING SHEET WATERFALL FOR POOL OR SPA

CROSS REFERENCE TO RELATED APPLICATION

This is a division of Ser. No. 07/972,404, filed Nov. 6, 1992, now abandoned.

BACKGROUND OF THE INVENTION

1. Field of the Invention

The invention relates to modules incorporated in the side walls and connected to the plumbing of swimming pools and spas to provide one or more sheet waterfalls pleasing to the eye and restful to the ear.

2. Prior Art

The art of producing sheet waterfalls is well developed.

Customary searches turned up a number of United States patents disclosing such devices, the most pertinent of which is Lesikar U.S. Pat. No. 4,881,280 dated Nov. 21, 1989 for Waterfall Producing Unit For Use In Swimming Pools.

Applicant's apparatus, like Lesikar's, is a modular unit integrated into the plumbing system of a pool, or spa; but differs in several respects including the arrangement for introducing water into the manifold chamber and emitting water therefrom. Applicant eliminates the baffles as well as the converging, elongated tapered throat featured in the Lesikar patent and, instead, provides a compact vent formed by a short, structurally strong channel which, nevertheless, affords free fall in a smooth laminar sheet.

Delepine U.S. Pat. No. 4,334,328, patented Jun. 15, 1982, and European Patent Office No. 275084 of 7/1988, both cited in the prosecution of the Lesikar application are also considered to be of interest in the field of sheet waterfall producing units; but here, again, both disclosures involve elongated spouts, for especial use in bathtubs where structural strength is not an important consideration as it frequently is in pool or spa installations.

SUMMARY OF THE INVENTION

It is an object of the invention to provide a self-contained plumbing fixture which is compact, structurally sturdy and relatively inexpensive to manufacture, yet which can readily be installed and plumbed to provide a wide variety of sheet waterfall effects, resulting in a more animated and interesting swimming pool, spa or landscape feature.

The modular fixture can be of any desired length, for example, one to eight or more feet, and of any configuration, such as linear, arcuate, S-shaped or even circular.

In a preferred embodiment, the apparatus of the invention comprises an elongated chamber defined by an encompassing wall including a front portion facing toward the pool, and top, back and bottom portions adapted to fit into and form part of the pool structure. End walls or equivalent barriers on the fixture are used to confine the water introduced into the manifold chamber from a water source, ordinarily a part of the pool's plumbing system.

A longitudinal opening along an element of the wall, such as along the top of the front portion of the wall, directs the water flow outwardly as it emerges, at a low velocity, from the chamber. An upper lip and a lower lip projecting outwardly from the top portion and front portion, respectively, provide an elongated channel serving to carry the water emerging from the opening to a location outwardly away from the front portion of the wall so that the sheet of water descends in free fall to the surface of the pool water, thereby enhancing the visual and audible aspects of the apparatus.

Central to the operation is the cooperation between the elongated manifold chamber, the elongated opening and the channel, on the one hand, and the water supply structure, on the other. Preferably, although not limited thereto, water from an external source is transferred to the chamber by a conduit extending at least part of, and often most or all of the entire length of the manifold chamber. The conduit is formed with special, longitudinally spaced apertures; and, since the conduit is ordinarily of circular cross-section, can conveniently be designated as a "flute". The apertures in the "flute" not only discharge the supply water into the chamber; they also serve, in conjunction with the relatively larger chamber, to reduce the water flow from a possibly turbulent state, as received from the water source, to or close to a laminar state so that as the water finally emerges from between the lips forming the longitudinal channel, the sheet is uninterrupted lengthwise and remains in laminar sheet form as it descends in free fall to the pool water below.

Longitudinally spaced dividers along the length of the chamber support the flute at any desired locations within the chamber; and, by properly configuring the dividers, special effects can be imposed on the sheet of water, such as splitting the waterfall into two or more longitudinal sections.

BRIEF DESCRIPTION OF THE DRAWING FIGURES

DETAILED DESCRIPTION OF A PREFERRED EMBODIMENT

Figure 1:
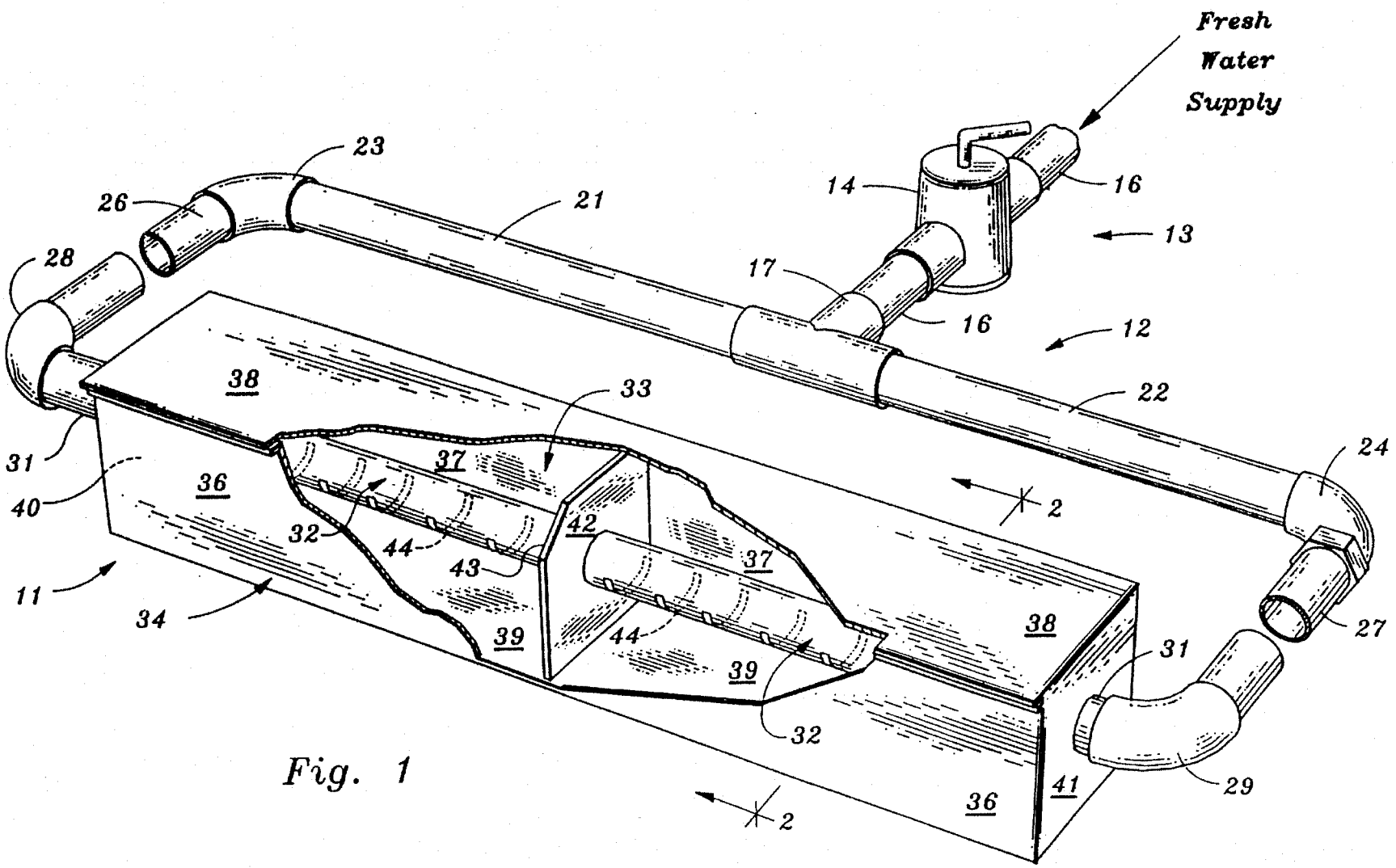
FIG. 1 is a front perspective view of a single unit, or module, showing a preferred form of the apparatus connected to a water supply line and with portions of the apparatus broken away to reveal internal structure.

While the waterfall producing apparatus of the present invention, generally designated by the reference numeral 11 can be incorporated in numerous different physical embodiments, depending upon the environment and requirements of use, the herein shown and described embodiment has been made and tested and has performed in a very satisfactory manner.

Preferably, although not limited thereto, the apparatus of the invention 11 comprises one or more individual units 12, or modules, each including plumbing 13 connected to a water supply, not shown, usually incorporated in the plumbing of the pool or spa being fitted with the waterfall apparatus.

The precise arrangement of the plumbing lines and the structural details by which the waterfall units are incorporated in the side walls and deck of the pool, spa or landscape construction are ordinarily spelled out in detail in the manufacturer's installation instructions, are well-known in the art and are therefore not specifically disclosed herein.

In order to provide a nice degree of control over the operation of the waterfall, a three-way valve 14 is placed in the feed line 16. Although not shown, the valve 14 is ordinarily located in a deck box, being thereby readily accessible yet out of the way of deck traffic around the pool or spa.

The feed line 16 from the valve 14 preferably terminates in a "T"-fitting 17, at which location the flow is divided, with substantially equal portions passing through pipes 21 and 22, thence through respective first "L"-fittings 23 and 24, connector pipes 26 and 27 and second "L"-fittings 28 and 29.

By appropriately choosing pipe sizes, the flow characteristics of the water can be enhanced in the direction of decreased turbulence. In other words, by making pipes 21, 22 and 26 and 27 the same internal diameter as feed line 16, for example, the flow velocity downstream from the "T"-fitting 17 is reduced.

Flow velocity, along with pipe diameter and, inversely, kinematic viscosity (a function of fluid viscosity and fluid density) are determinative of the well known dimensionless Reynolds number, which, among numerous other uses, provides a criterion of the transition between turbulent and laminar, or viscous, flow. Thus the flow velocity reduction resulting from splitting the flow, in the manner disclosed, also effects a significant move toward reducing turbulence.

Thus, when the feed water from the second "L"-fittings 28 and 29 enters the opposite ends 31 of the flute 32, the Reynolds number, a measure of the turbulence, has already been reduced, thereby facilitating the transition to the laminar flow required to produce a sheet type of waterfall.

Still further reduction in turbulence is attained by the manner in which the water in the flute 32 is emitted into a surrounding elongated manifold chamber 33 defined by an encompassing longitudinal manifold wall 34 comprising, in the embodiment disclosed, a front portion 36, a rear portion 37, a top portion 38 and a bottom portion 39.

The opposite ends of the longitudinal manifold chamber 33 are defined by transverse end wall portions 40 and 41; and supporting the mid-section of the flute 32, where necessary, is a transverse divider 42, or plate, or partition, dividing the chamber 33 into two sections.

As will be appreciated, the number and placement of the transverse plates 42, should such plates be deemed necessary, are within the realm of well recognized structural design techniques. If desired, the longitudinal dimension, or thickness, of the plate 42, or plates, can be increased, to provide a plurality of discrete waterfalls, or as in the arrangement shown in FIG. 1, the upper left hand corner of the plate 42 can be excised along an oblique line 43 to provide a unitary chamber 33 in which the waterfall extends the full length of the manifold.

Figure 2:
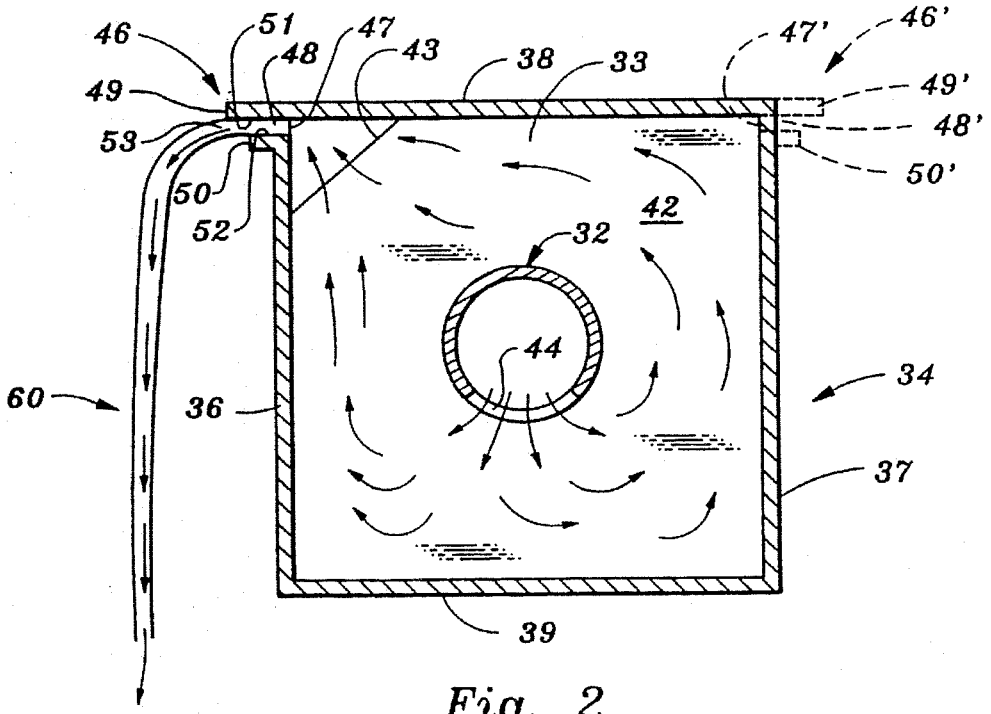
FIG. 2 is a transverse section, to an enlarged scale, the section being taken on the line 2—2 in FIG. 1.
Figure 5:
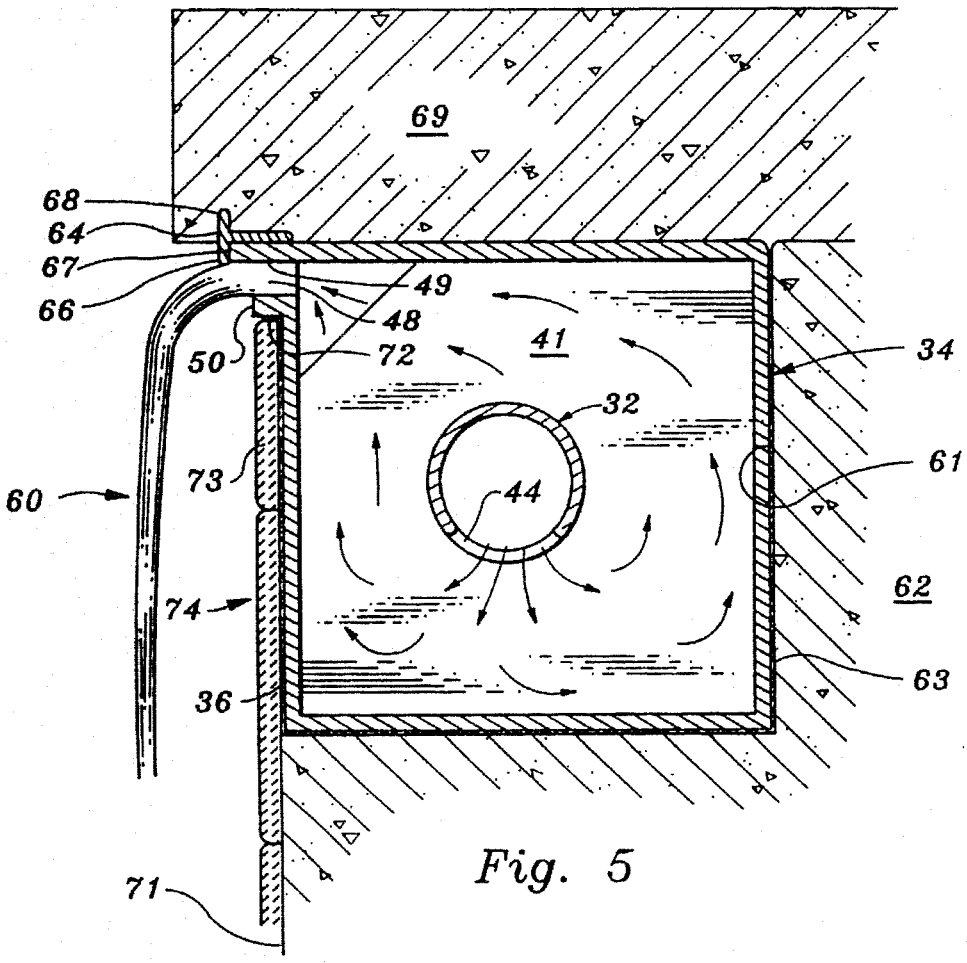
FIG. 5 is a view comparable to that of FIG. 2, but illustrating the apparatus installed in a typical environment.

As appears most clearly in FIGS. 2 and 5, the water, at a velocity already considerably reduced from that obtaining in the feed line 16, emerges from the flute 32 through a plurality of transverse, longitudinally spaced apertures 44, preferably located in the bottom portion of the flute.

The apertures 44 can be of several different configurations; but it has been determined that a plurality of transverse quadrantal slots, spaced approximately two inches apart, along the length of the flute 32, have served quite satisfactorily, to emit the supply water into the enlarged manifold chamber 33 in such a manner as to enhance the velocity-lowering effect and ensure a reduction in the Reynolds number to an amount that, coupled with the outwardly projecting, sheet waterfall forming structure 46, or emitter, a laminar, or viscous, flow is attained despite the usual turbulent flow which obtains in the upstream feed line 16.

In other words, the flow velocity of the water emerging from the transverse slots 44 in the flute 32 is markedly reduced as it enters the enlarged manifold chamber 33. The Reynolds number is estimated to be reduced to the transition range of about 2000–3000. Thus, as the water passes outwardly from the chamber 33 through an elongated opening 47 preferably located along a longitudinal element of the encompassing longitudinal wall 34, at the corner of the top portion 38 and the front wall portion 36, as appears most clearly in FIG. 2, the flow is at a low velocity.

The longitudinal opening 47, it will be noted, is at a location considerably removed from the plurality of longitudinally spaced, transverse apertures 44 in the flute 32. Thus, the flow velocity of the water emergent from the apertures 44 is quickly reduced to below the transition Reynolds number, as it transits the intervening portion of the chamber 33, as indicated by the directional arrows in FIG. 2.

In summary, when the water emerges from the elongated channel 48 formed by an upper lip 49 projecting from the upper edge of the opening 47 and a lower lip 50 projecting from the lower edge of the opening 47, it is in laminar flow state and the water free falls in sheet form.

By making the upper lip 49 project somewhat beyond the lower lip 50, advantage is taken of the "Wall Attachment" or "Coanda" effect, named after Henri Coanda, a Romanian, who carried out significant fluid investigations in France in the 1930's. The principle applies to any fluid as long as laminar flow is maintained. The Coanda effect results from the atmospheric pressure acting all around the water except where the water contacts a solid wall, the atmosphere pressing the water against the surface, here, the lower surface 51 of the upper lip 49; or, at least, a portion of the lower surface 51 projecting outwardly beyond the upper surface 52 of the lower lip 50.

As a consequence, the escaping stream, or nappe, springs clear of the lips in a profile somewhat similar to that found by water flowing over a sharp-crested free surface weir. See FIG. 2 which illustrates the approximate flow profile.

In other words, as shown in stylized manner, in FIG. 2, as water emerges through the apertures 44 in the flute 32, it flows into and through the enlarged manifold chamber 33 defined by the encompassing elongated wall 34 and simultaneously loses much of its velocity. Thus, water which discharges through the aperture 44 can be in laminar state or, which is more likely, in a somewhat turbulent condition, with flow slightly in excess of critical velocity, namely the velocity corresponding to the change from turbulent to laminar or viscous flow, with a Reynolds number of approximately 2500. Upon entering the chamber 33 and progressing through the elongated opening 47 and channel 48, however, the flow is laminar in nature.

Thus, the nappe 53, is well clear of the outermost edge of the lower lip 50 when, under the influence of gravity, the stream turns downwardly. Concurrently, surface tension comes into play, maintaining the stream in sheet form and preventing dispersion even at the lower ends of the sheet, except on very windy days or where the vertical fall exceeds several feet.

The configuration and placement of the apparatus of the invention can be varied. It has been found, however, that the arrangement shown in the drawing Figures has served as a satisfactory module. The module can be formed in sizes of from one to about eight feet in length, with the longer size flutes 32, supported in one or more locations by a plate 42.

Should dividers 42 be utilized, either for flute support or for waterfall interrupters, depending upon plate width or other expedients for separating the extent of the water sheet, in a longitudinal aspect, the waterfall pattern can readily be altered to suit the pattern desired.

Figure 3:
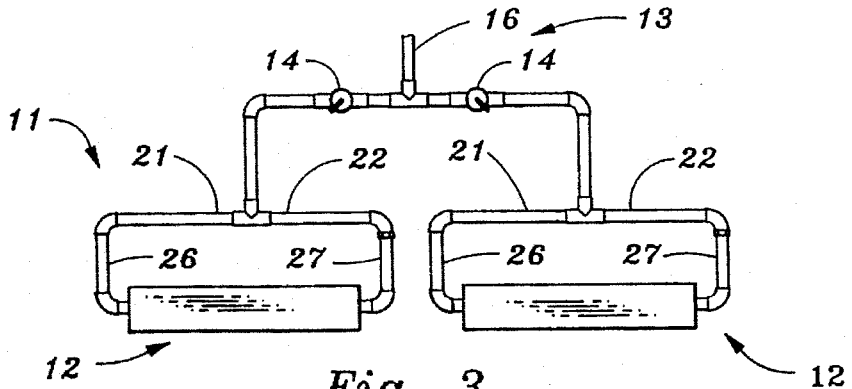
FIG. 3 is a schematic showing, to a reduced scale, of two modules connected to a common water supply.
Figure 4:
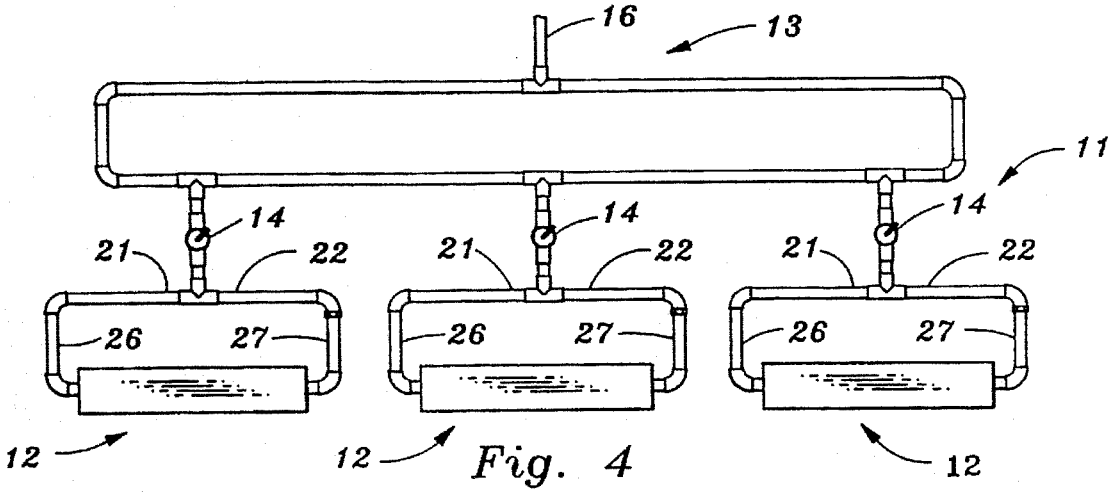
FIG. 4 is a schematic showing, similar to FIG. 3, but illustrating a preferred arrangement for connecting a three-unit array.

The self-contained unit, or module, can be arranged in a great variety of configurations, including the fundamental linear plan indicated schematically in FIGS. 3 and 4. Other geometrical arrangements are also possible.

The placement of the flute 32 within the chamber 33, as well as the size, shape and location of the apertures 44 in the flute 32 are subject to variant treatment.

In the particular form shown in FIGS. 1, 2 and 5, the apertures 44 are transverse slots which subtend an angle of approximately ninety degrees and therefore are quadrantal in extent, as previously stated.

FIGS. 2 and 5 illustrate the components in approximately actual size. On this scale, the apertures 44 are preferably spaced about two inches apart, longitudinally, on the flute 32; and the manifold chamber 33 and the water supply flute 32 have been arranged about as shown.

The "Coanda effect", it is believed, causes the stream to make a "clean" discharge from the overhang arrangement of the short lips, thereby providing compactness and effecting economies of construction while giving a smooth, well-defined, sheet contour to the curtain of water descending into the pool, or spa.

The elongated carefully profiled throat structure disclosed in prior art units has been made unnecessary. Yet, the smooth, viscous flow, resulting from the predetermined arrangement of velocity reducing components, yields a pleasing, uninterrupted waterfall. FIGS. 3 and 4 show, schematically, how two and three modules can be plumbed to provide multiple waterfalls, if desired. Other physical arrangements are, of course, possible, bearing in mind that if numerous waterfalls are to be installed, a booster pump (not shown) may be required in order to help equalize the flow to all units.

Although the embodiment heretofore described and shown in FIGS. 1 and 2 discharges through the channel 48, located adjacent the corner formed by the front portion 36 and the top portion 38 of the longitudinal chamber encompassing wall 34, it should also be recognized that in certain environments, especially in landscaping, it may be desirable to have waterfalls emerge from both sides of the unit. In this event, as illustrated in broken line in FIG. 2, a second elongated opening 47' is provided, adjacent the corner formed by the top portion 38 and the rear portion 37 of the elongated wall 34. As before, a waterfall forming structure 46' or emitter, comprising an upper lip 49' and a lower lip 50' arranged to define a channel 48' can be provided Where a second waterfall is utilized, as just described, the water emitted from the apertures 44 divides, with equal portions migrating to the two ports 47 and 47' thence outwardly and into free fall, in sheet form, on both sides of the manifold.

Since the apparatus of the present invention provides a sheet waterfall by a short, overhanging upper lip construction, as previously described, economies of construction, without a sacrifice of strength, are obtained. In other words, as appears most clearly in FIG. 5, the manifold 34 is readily fitted into a pre-cut notch 61 in the bond beam 62 around the perimeter of the pool or spa and secured with a bonding layer 63 of thin set concrete.

If desired, an elongated key 64, T-shaped in transverse section, can be positioned horizontally so that one arm 66 of the T-shaped key 64 abuts the outer end 67 of the upper lip 49 and the other arm 68 of the key is located within a keyway formed in the beam 69, or deck coping. Since the front portion 36 of the manifold 34 is flush with the pool or spa wall surface 71, the lower face 72 of the lower lip 50 provides an ideal upper abutment for the top course 73 of tile 74. Because of the short length of the lips 49 and 50 and the vertically co-planar construction of the outermost surfaces of the lower lip 50 and the tile 74, the sheet waterfall 60 appears to emerge directly from the tile and presents a most appealing visual effect. At the same time, as a result of the short length of the lips, compact structural integrity and strength are maintained.

Inasmuch as laminar flow conditions where the water enters the channel 48 is desirable for optimum shaping of the waterfall 60 as it emerges from between the lips 49 and 50 and since the transition from turbulent to laminar flow, at a Reynolds number of approximately 2500, can be effected in a number of different ways, it is believed appropriate, at this juncture, to touch upon the subject in brief fashion.

As previously noted, one widely recognized expedient for reducing turbulence is the introduction of a turbulent flow stream into an enlarged conduit, or chamber, thereby reducing the flow velocity, one of the direct variables in the Reynolds number equation. In the present embodiment, the transition from a single conduit to two conduits is one arrangement for reducing the flow turbulence. Another is the movement from the apertures 44 in the flute 32 to a relatively large manifold chamber 33.

Although the shape, size and spacing of the apertures 44 is susceptible of numerous variations, it has been found that the longitudinally spaced, quadrantal slot on the bottom of the flute provides a very acceptable result in that flow metering is automatically achieved.

Figure 6:
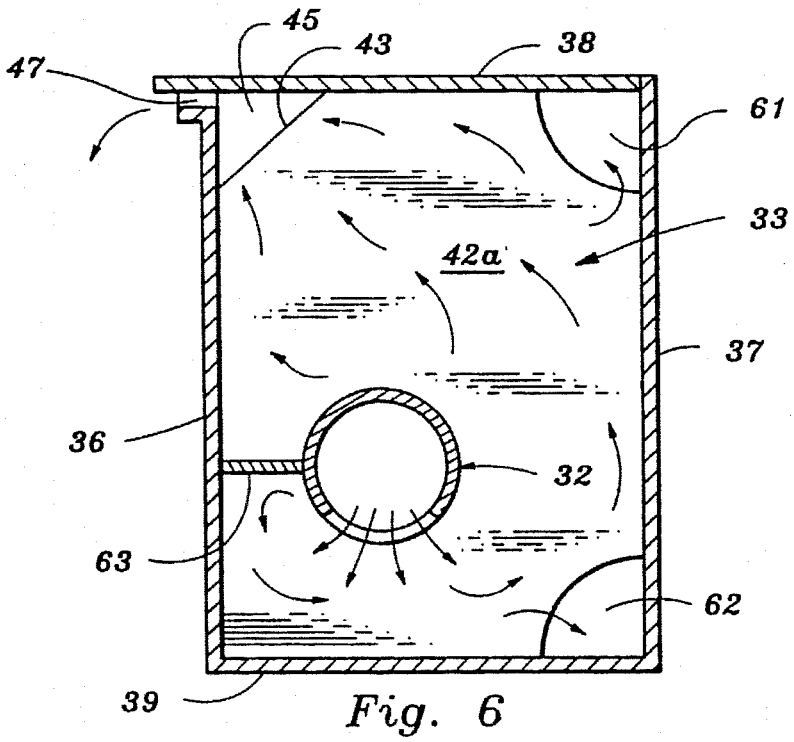
FIG. 6 is a transverse section, comparable to that of FIG. 2, of a modified form of manifold.

FIG. 6 illustrates, in cross-section, a variant form of manifold construction in which a transverse plate **42*a*, or divider, supporting the flute 32 includes not only a triangular cut-out portion 45 defined by the oblique line 43, but, also, a cut-out portion 61 at the upper rear corner and a cut-out portion 62 at the lower rear corner. These three openings 45, 61 and 62 allow longitudinal flow of water between separate chambers so that the pressure of the water in all the chambers is substantially equal, with the result that the waterfall sheet is uniform in appearance throughout the length of the manifold. This is an especially important consideration where the manifold is of a length such that multiple transverse support plates are required, leading, in turn to multiple chambers. FIG. 6 also illustrates the use of a barrier wall 63 spanning the distance between the flute 32 and the adjacent surface of the front wall portion 36. The barrier wall 63 extends the length of the chamber 33 and forces the water emerging from the transverse apertures 44 to travel "the long way around" before passing through the opening 47**.

Figure 7:
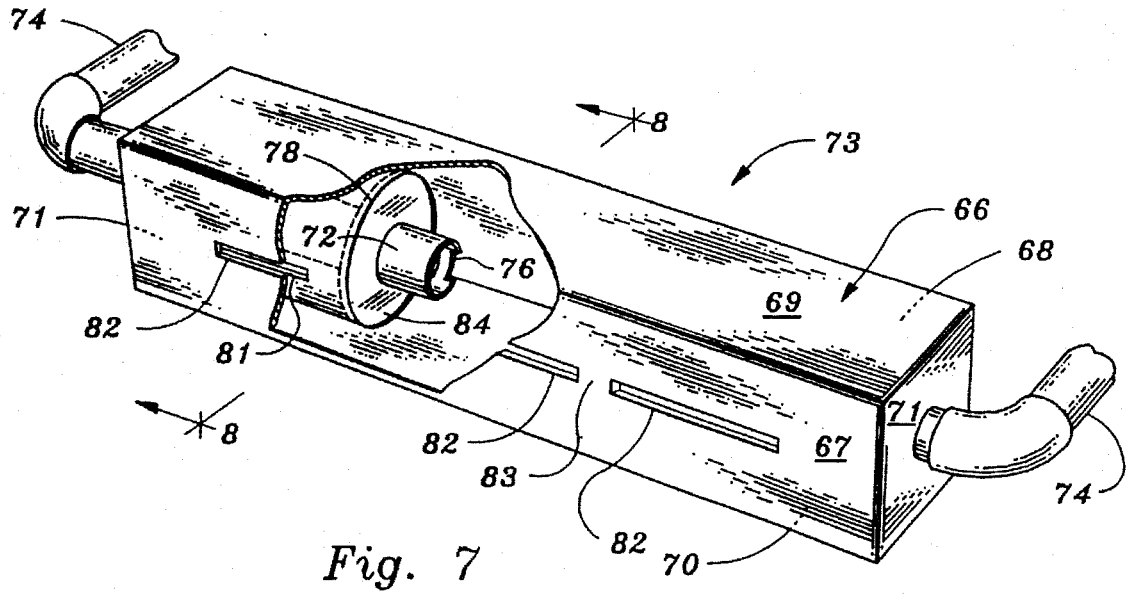
FIG. 7 is a view similar to that of FIG. 1, but showing a further modified form of manifold.
Figure 8:
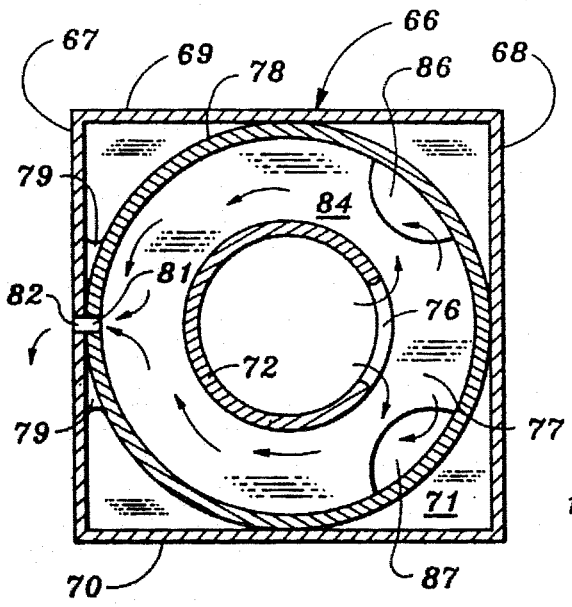
FIG. 8 is a transverse section, taken on the line 8—8 in FIG. 7; and, FIG. 9 is a transverse section of still a further modification of the manifold of the invention.

FIGS. 7 and 8 illustrate a modification in which a square-in-section outer casing 66 includes a front wall 67, a rear wall 68, a top wall 69, a bottom wall 70, and a pair of opposite end walls 71. A flute 72 extends the full length of the manifold 73 and is supplied with water from opposite end pipes 74 connected, as before, to a water supply. Water emerges from a plurality of segmental slots 76 in the rear side of the flute 72 and enters the annular space 77 defined by the flute and the larger concentrically located pipe 78 which, in turn is tangent to the respective inner surfaces of the casing 66 (see FIG. 8). The larger pipe 78 is secured in the casing by any suitable means, such as adhesive 79; and a longitudinal slot 81 in the larger pipe 78 registers with a longitudinal slot 82 in the front wall 67 of the casing 66 so that the water emerging from the slot 76 in the flute 72 and passing around the annular space 77 flows in a laminar state through the slots 81 and 82 and descends in sheet form to the water below. In this embodiment, there are three discrete portions to the waterfall, each portion being divided by an interruption 83 in the longitudinal slot 82 in the front wall 67. Annular partitions 84 support the flute 72 and since there are two such partitions in the embodiment shown in FIG. 7, each partition 84 being located in the same transverse plane as the interruptions 83 in the slot 82, a pair of opening 86 and 87 is formed in the partitions to provide longitudinal water flow and thereby help equalize water pressure in all three annular chambers.

Figure 9:
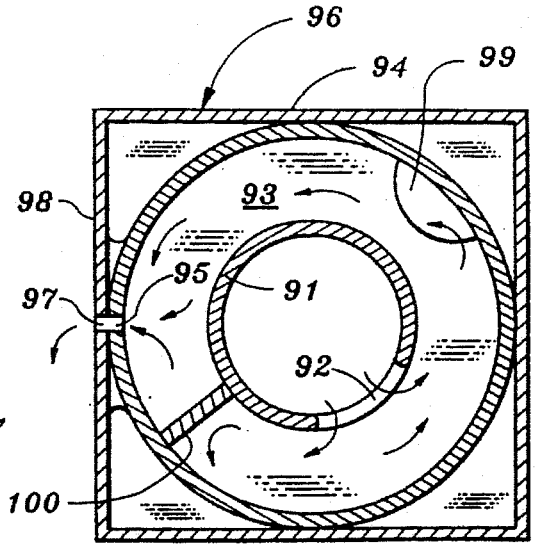

FIG. 9 illustrates a further modification in which a flute 91, with a plurality of segmental openings 92 facing toward the lower right corner, is centered by one or more annular partitions 93 in a larger concentric pipe 94 tangent at four points within the casing 96. As before, the water flows through a longitudinal slot 95 in the pipe 94 and emerges from a registering longitudinal slot 97 in the front wall 98 of the casing 96. An opening 99 in the annular partition 93 provides longitudinal water flow between the chambers, and a longitudinal barrier wall 100 extending between adjacent partitions 93 forces the water to take the longest path from the apertures 92 to the outlet 97.

I claim:

1. Apparatus for producing a sheet waterfall for a pool or spa, comprising:

an elongated chamber defined in part by a longitudinal encompassing wall, said wall including a longitudinal opening, means including an apertured conduit extending into the chamber for introducing water into the chamber and establishing a laminar flow of water through the opening, said conduit having a fitting for connection to a water supply and at least one aperture for emitting water into the chamber, and a hollow longitudinally extending square-in-section casing encompassing the longitudinal encompassing wall, said casing having a longitudinal slot in registration with the longitudinal opening in the wall.

2. In apparatus for producing a sheet-like waterfall: an elongated housing of generally rectangular cross-section, a longitudinally elongated opening in one wall of the housing, a longitudinally extending conduit within the housing adapted for connection to a supply of pressurized water and having a plurality of longitudinally spaced apertures for emitting water into the housing for discharge in sheet-like form through the opening in the housing wall.

3. The apparatus of claim 2 wherein the opening is positioned toward one corner of the housing.

4. The apparatus of claim 2 including an upper lip projecting laterally from an upper edge of the opening and a lower lip projecting from a lower edge of the opening, said lips defining a channel for water flowing from the opening.

5. The apparatus of claim 4 wherein the upper lip projects farther from the wall than the lower lip.

6. The apparatus of claim 4 wherein the lower lip projects from the wall by a distance corresponding to the thickness of a tile mounted on the wall.

7. The apparatus of claim 2 wherein the apertures in the conduit face away from the opening the housing wall.

8. The apparatus of claim 7 including a baffle extending between the conduit and the wall for constraining the water to flow around the conduit in a predetermined direction from the apertures to the opening.

9. The apparatus of claim 2 including a chamber having a wall of generally circular configuration in cross-section disposed coaxially about the conduit within the housing and having a slotted opening in registration with the opening in the housing wall.

10. The apparatus of claim 9 including a baffle extending between the conduit and the chamber wall constraining the water to flow around the conduit in a predetermined direction from the apertures to the openings.

11. In apparatus for producing a sheet-like waterfall: a substantially cylindrical elongated housing having a longitudinally extending elongated opening therein, a longitudinally extending conduit within the housing adapted for connection to a supply of pressurized water and having a plurality of longitudinally spaced apertures facing away from the opening, and a pair of laterally projecting lips extending along opposite sides of the opening and defining a channel for water discharged through the opening.

12. The apparatus of claim 11 wherein the lips are positioned one above the other, and the uppermost lip has a greater lateral projection than the lowermost lip.

13. The apparatus of claim 11 wherein the lips extend from the housing at a height above the conduit.

14. In apparatus for producing a sheet-like waterfall: an elongated housing having a rectangular cross section and a longitudinally extending elongated opening therein, a longitudinally extending conduit within the housing adapted for connection to a supply of pressurized water and having a plurality of longitudinally spaced apertures facing away from the opening, and a pair of laterally projecting lips extending along opposite sides of the opening and defining a channel for water discharged through the opening.

15. Apparatus for producing sheet waterfall for pool or spa, said apparatus comprising:

a. an elongated chamber extending along an axis and defined in part by a longitudinal encompassing wall, said wall including a longitudinal opening;

b. means for introducing water into said chamber; and, c. means for establishing laminar flow through said opening of water introduced into said chamber, said means including an apertured conduit extending into said chamber parallel to said axis, said conduit including a fitting adapted to be connected to a water supply and a plurality of apertures spaced apart longitudinally in said conduit for the emission of water into said chamber, each of said apertures comprising a slot which is substantially a quadrant in angular extent and is transverse to said axis, the size of said chamber being large relative to the size of said plurality of apertures so that the velocity of the water emitted from said plurality of apertures into said chamber is substantially reduced.

16. Apparatus as in claim 15 including at least one divider located transversely to said axis in said chamber to subdivide said chamber into at least two sections.

17. Apparatus as in claim 15 in which said encompassing wall includes a front portion, a back portion, a top portion and a bottom portion; and in which said longitudinal opening is located adjacent the junction of the front portion and top portion of said wall.

18. Apparatus as in claim 17 in which said transverse slots face away from said opening, and the width of said chamber between said front portion and said back portion exceeds the transverse dimension of said conduit to afford a passageway for the flow of water from said slots to said opening, the volumetric extent of said passageway being sufficient to reduce the velocity of the water to laminar range.

19. Apparatus as in claim 18, including an upper lip extending from said top portion and a lower lip extending from said front portion adjacent said opening, said lips defining a channel for water flowing from said opening, said upper lip projecting outwardly away from said top portion, and said lower lip projecting outwardly away from said front so that water emergent from said channel falls clear of said front portion in the form of a sheet.

20. Apparatus as in claim 19 in which said upper lip is longer than said lower lip.

21. Apparatus for producing sheet waterfall for pool or spa, said apparatus comprising:

a. an elongated chamber extending along an axis and defined in part by a longitudinal encompassing wall, said wall including a longitudinal opening defined by an upper edge and a lower edge;

b. a conduit extending into said chamber parallel to said axis, said conduit including a plurality of apertures for the emission of water into said chamber and a fitting adapted to be connected to a water supply; and, c. an emitter including an upper lip projecting from said upper edge and a lower lip projecting from said lower edge, said lips defining a channel for water flowing from said opening, the length of said lower lip being approximately equal to the thickness of a pool or spa tile and the length of said upper lip being greater than the length of said lower lip to provide an overhanging portion, the size of said chamber being large relative to the size of said plurality of apertures so that the velocity of the water emitted from said plurality of apertures into said chamber when said chamber is filled with water results in a substantial reduction in the Reynolds number characterizing the stream of water flowing toward said opening.

22. Apparatus as in claim 21 in which the size of said opening is selected so that the flow of water emergent from said chamber into said channel is laminar in nature thereby causing the water first to cling to said overhanging portion then to spring clear of said lips and assume sheet form in free fall.

23. Apparatus as in claim 22 in which said apertures face in a direction away from said opening to increase the length of flow path of the water as it transits said chamber from said apertures to said opening.

24. Apparatus for producing a waterfall at a side of a swimming pool, said apparatus comprising:

a generally cylindrical reservoir adapted to be connected in the water circulation system of said pool, said reservoir having an elongate slot formed in a side wall thereof;

at least one water discharge metering rod positioned on the axial centerline of said reservoir;

nozzle means formed in said rod configured, dimensioned, and arranged for directing water in a direction diametrically opposite said elongate slot; and means for directing water from said reservoir through said elongate slot to the side of said pool.

25. The apparatus according to claim 24 wherein said means for directing water from said reservoir to the side of said pool includes a discharge plenum having an elongate opening for passage of water therefrom into said pool.

26. The apparatus according to claim 25 wherein said plenum has one end in fluid flow communication with the elongate slot of said reservoir.

27. The apparatus according claim 24 wherein said apparatus includes first and second generally identically configured water discharge metering rods coaxially positioned on the axial centerline of said reservoir.

* * * * *